US011454910B2

(12) United States Patent
Iwaya et al.

(10) Patent No.: US 11,454,910 B2
(45) Date of Patent: Sep. 27, 2022

(54) NIP FORMATION MEMBER HAVING A BASE, A THERMAL CONDUCTOR, AND A STABILIZER, AND FIXING DEVICE AND IMAGE FORMING APPARATUS USING THE SAME

(71) Applicants: Naoki Iwaya, Tokyo (JP); Hitoshi Fujiwara, Kanagawa (JP)

(72) Inventors: Naoki Iwaya, Tokyo (JP); Hitoshi Fujiwara, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/413,586

(22) PCT Filed: Feb. 19, 2020

(86) PCT No.: PCT/JP2020/006409
§ 371 (c)(1),
(2) Date: Jun. 14, 2021

(87) PCT Pub. No.: WO2020/179444
PCT Pub. Date: Sep. 10, 2020

(65) Prior Publication Data

US 2022/0075302 A1 Mar. 10, 2022

(30) Foreign Application Priority Data

Mar. 4, 2019 (JP) ..... JP2019-038896
Jun. 24, 2019 (JP) ..... JP2019-116116

(51) Int. Cl.
*G03G 15/20* (2006.01)

(52) U.S. Cl.
CPC ..... *G03G 15/2057* (2013.01); *G03G 15/2064* (2013.01); *G03G 2215/2038* (2013.01)

(58) Field of Classification Search
USPC ..... 399/328
See application file for complete search history.

(56) References Cited

U.S. PATENT DOCUMENTS

2011/0044706 A1 2/2011 Iwaya et al.
2011/0064443 A1 3/2011 Iwaya et al.
(Continued)

FOREIGN PATENT DOCUMENTS

JP 2016-102894 2/2016
JP 2016-114619 6/2016
(Continued)

OTHER PUBLICATIONS

Translation of cited documents JP2016/4102894A to Ogino et al. (Year: 2016).*

(Continued)

*Primary Examiner* — Quana Grainger
(74) *Attorney, Agent, or Firm* — Xsensus LLP

(57) ABSTRACT

A nip formation member includes a base, a high thermal conduction member, and a securing member. The high thermal conduction member has a thermal conductivity greater than a thermal conductivity of the base. The securing member is independent from the base and the high thermal conduction member. The securing member is configured to restrict movement of the base relative to the high thermal conduction member.

13 Claims, 11 Drawing Sheets

(56) References Cited

U.S. PATENT DOCUMENTS

| | | | | |
|---|---|---|---|---|
| 2011/0206427 | A1 | 8/2011 | Iwaya et al. | |
| 2011/0211876 | A1 | 9/2011 | Iwaya et al. | |
| 2011/0229181 | A1 | 9/2011 | Iwaya et al. | |
| 2013/0183071 | A1 | 7/2013 | Iwaya et al. | |
| 2013/0251422 | A1 | 9/2013 | Iwaya et al. | |
| 2015/0063884 | A1 | 3/2015 | Iwaya et al. | |
| 2015/0090564 | A1 | 4/2015 | Iwaya et al. | |
| 2016/0274511 | A1* | 9/2016 | Ogino | G03G 15/2064 |
| 2016/0378028 | A1 | 12/2016 | Fujiwara et al. | |
| 2017/0255149 | A1 | 9/2017 | Takagi et al. | |
| 2019/0258196 | A1 | 8/2019 | Iwaya | |

FOREIGN PATENT DOCUMENTS

| | | |
|---|---|---|
| JP | 2016-114743 | 6/2016 |
| JP | 2016-114876 | 6/2016 |
| JP | 2017-049618 | 3/2017 |
| JP | 2017-161880 | 9/2017 |
| JP | 2017-173359 | 9/2017 |

OTHER PUBLICATIONS

International Search Report dated Jun. 2, 2020 in PCT/JP2020/0064069 filed on Feb. 19, 2020.

* cited by examiner

NIP FORMATION MEMBER HAVING A BASE, A THERMAL CONDUCTOR, AND A STABILIZER, AND FIXING DEVICE AND IMAGE FORMING APPARATUS USING THE SAME

CROSS-REFERENCE TO RELATED APPLICATIONS

The present application is based on PCT filing PCT/JP2020/006409, filed Feb. 19, 2020, which claims priority to JP 2019-038896, filed Mar. 4, 2019, and JP 2019-116116, filed Jun. 24, 2019, the entire contents of each are incorporated herein by reference.

TECHNICAL FIELD

Embodiments of the present disclosure relate to a nip formation member, a fixing device incorporating the nip formation member, and an image forming apparatus incorporating the fixing device.

BACKGROUND ART

A fixing device including a cylindrical fixing belt is provided with a nip formation member that contacts an inner circumferential surface of the fixing belt to form a fixing nip between the fixing belt and an opposed member such as a pressure roller.

Such a nip formation member often includes a high thermal conduction member having a relatively high thermal conductivity on a fixing-belt side of the nip formation member opposite the fixing belt, to equalize the temperature of the fixing belt in a width direction of the fixing belt.

For example, as illustrated in FIG. 12, PTL 1 (Japanese Unexamined Patent Application Publication No. 2017-161880) describes a nip formation member 102 that contacts an inner circumferential surface of a fixing belt 101. The nip formation member 102 includes a base 103 and a high thermal conduction member 104 having a thermal conductivity greater than a thermal conductivity of the base 103. The high thermal conduction member 104 includes restricting portions 104*a* and 104*b* on opposed transverse sides of the high thermal conduction member 104. The restricting portions 104*a* and 104*b* are formed by bending a copper plate a plurality of times. As the restricting portion 104*b* is engaged with a recess 103*a* of the base 103, the base 103 and the high thermal conduction member 104 are positioned relative to each other.

CITATION LIST

Patent Literature

PTL 1: Japanese Unexamined Patent Application Publication No. 2017-161880

SUMMARY OF INVENTION

Technical Problem

However, the structural engagement of the base 103 and the high thermal conduction member 104 due to the shapes of the base 103 and the high thermal conduction member 104 as described in PTL 1 might increase an error in assembly of the base 103 and the high thermal conduction member 104.

Solution to Problem

In order to address the above-described problem, there is provided a nip formation member as described in appended claims. Advantageous embodiments are defined by the dependent claims. Advantageously, the nip formation member includes a base, a high thermal conduction member, and a securing member. The high thermal conduction member has a thermal conductivity greater than a thermal conductivity of the base. The securing member is independent from the base and the high thermal conduction member. The securing member is configured to restrict movement of the base relative to the high thermal conduction member.

Advantageous Effects of Invention

Accordingly, the base and the high thermal conduction member are secured to each other by another component, thereby being accurately positioned relative to each other.

BRIEF DESCRIPTION OF DRAWINGS

The accompanying drawings are intended to depict example embodiments of the present invention and should not be interpreted to limit the scope thereof. The accompanying drawings are not to be considered as drawn to scale unless explicitly noted. Also, identical or similar reference numerals designate identical or similar components throughout the several views.

DESCRIPTION OF EMBODIMENTS

Figure 1:
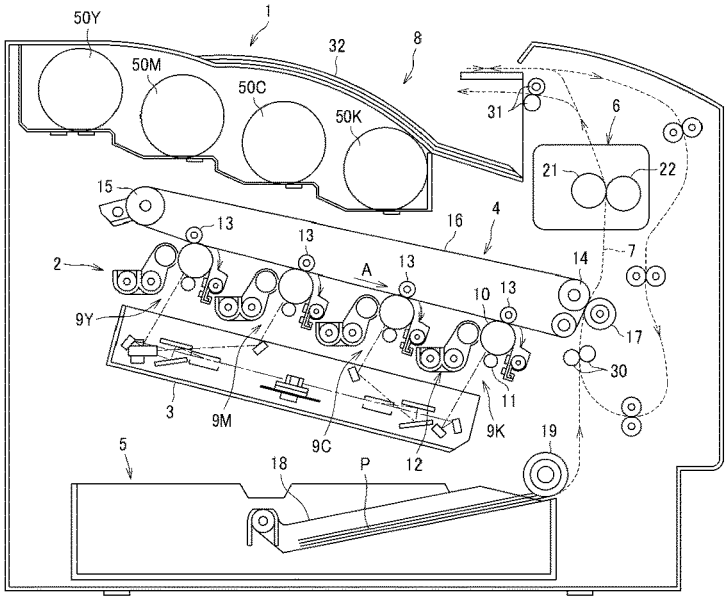
FIG. 1 is a schematic view of an image forming apparatus according to an embodiment of the present disclosure.

The terminology used herein is for the purpose of describing particular embodiments only and is not intended to be limiting of the present invention. As used herein, the singular forms "a", "an" and "the" are intended to include the plural forms as well, unless the context clearly indicates otherwise. In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result. In a later-described comparative example, embodiment, and exemplary variation, for the sake of simplicity, like reference numerals are given to identical or corresponding constituent elements such as parts and materials having the same functions, and redundant descriptions thereof are omitted unless otherwise required. Referring now to the drawings, wherein like reference numerals designate identical or corresponding parts throughout the several views, embodiments of the present disclosure are described below.

Initially with reference to FIG. 1, a description is given of an overall configuration of an image forming apparatus 1 according to an embodiment of the present disclosure. FIG. 1 is a schematic view of the image forming apparatus 1. In the present embodiment, the image forming apparatus 1 is a color image forming apparatus that forms color and monochrome images on recording media by electrophotography. As illustrated in FIG. 1, the image forming apparatus 1 includes an image forming device 2 disposed in a center portion of the image forming apparatus 1. The image forming device 2 includes four removable process units 9Y, 9M, 9C, and 9K. The process units 9Y, 9M, 9C, and 9K have identical configurations, except that the process units 9Y, 9M, 9C, and 9K contain developers in different colors, that is, yellow (Y), magenta (M), cyan (C), and black (K) corresponding to color-separation components of a color image.

Specifically, each of the process units 9Y, 9M, 9C, and 9K includes, e.g., a photoconductor 10, a charging roller 11, and a developing device 12. The photoconductor 10 is a drum-shaped rotator serving as an image bearer that bears toner as a developer on a surface of the photoconductor 10. The charging roller 11 uniformly charges the surface of the photoconductor 10. The developing device 12 includes a developing roller to supply toner to the surface of the photoconductor 10.

Below the process units 9Y, 9M, 9C, and 9K is an exposure device 3. The exposure device 3 emits a laser beam onto the surface of the photoconductor 10 according to image data.

Above the image forming device 2 is a transfer device 4. The transfer device 4 includes, e.g., a drive roller 14, a driven roller 15, an intermediate transfer belt 16, and four primary transfer rollers 13. The intermediate transfer belt 16 is an endless belt rotatably entrained around, e.g., the drive roller 14 and the driven roller 15. Each of the four primary transfer rollers 13 is disposed opposite the corresponding photoconductor 10 of the process units 9Y, 9M, 9C, and 9K via the intermediate transfer belt 16. At the position opposite the photoconductor 10, each of the four primary transfer rollers 13 presses an inner circumferential surface of the intermediate transfer belt 16 against the corresponding photoconductor 10 to form an area of contact, herein referred to as a primary transfer nip, between a pressed portion of the intermediate transfer belt 16 and the photoconductor 10.

A secondary transfer roller 17 is disposed opposite the drive roller 14 via the intermediate transfer belt 16. The secondary transfer roller 17 is pressed against an outer circumferential surface of the intermediate transfer belt 16 to form an area of contact, herein referred to as a secondary transfer nip, between the secondary transfer roller 17 and the intermediate transfer belt 16. The drive roller 14, the intermediate transfer belt 16, and the secondary transfer roller 17 construct an image transfer unit that transfers an image onto a sheet P serving as a recording medium.

In a lower portion of the image forming apparatus 1 is a sheet feeder 5 that includes, e.g., a sheet tray 18 and a sheet feeding roller 19. The sheet tray 18 loads one or more sheets P serving as a recording medium or recording media. The sheet feeding roller 19 picks up and feeds the sheets P one by one from the sheet tray 18 toward the secondary transfer nip formed between the intermediate transfer belt 16 and the secondary transfer roller 17.

The sheets P are conveyed along a conveyance passage 7, defined by internal components of the image forming apparatus 1, from the sheet feeder 5 toward a sheet ejector 8. Conveyance roller pairs including a registration roller pair 30 are disposed as appropriate along the conveyance passage 7.

The fixing device 6 includes a fixing belt 21 heated by a heating member, a pressure roller 22 that presses against the fixing belt 21, and the like.

The sheet ejector 8 is disposed in a most downstream part of the conveyance passage 7 in a direction of conveyance of the sheet P (herein after referred to as a sheet conveying direction) in the image forming apparatus 1. The sheet ejector 8 includes a sheet ejection roller pair 31 and an output tray 32. The sheet ejection roller pair 31 ejects the sheets P one by one onto the output tray 32 disposed atop a housing of the image forming apparatus 1. Thus, the sheets P lie stacked on the output tray 32.

In an upper portion of the image forming apparatus 1, removable toner bottles 50Y, 50M, 50C, and 50K are disposed. The toner bottles 50Y, 50M, 50C, and 50K are replenished with fresh toner of yellow, magenta, cyan, and black, respectively. A toner supply tube is interposed between each of the toner bottles 50Y, 50M, 50C, and 50K and the corresponding developing device 12. The fresh toner is supplied from each of the toner bottles 50Y, 50M, 50C, and 50K to the corresponding developing device 12 through the toner supply tube.

To provide a fuller understanding of the embodiments of the present disclosure, a description is now given of an image forming operation of the image forming apparatus 1 with continued reference to FIG. 1.

As the image forming apparatus 1 starts the image forming operation in response to a print job assigned to the image forming apparatus 1, the exposure device 3 emits laser beams to the surface of the photoconductor 10 of each of the process units 9Y, 9M, 9C, and 9K according to image data, thus forming an electrostatic latent image on the surface of the photoconductor 10. The image data used to expose the photoconductor 10 with the exposure device 3 is single color image data produced by decomposing a desired full color image into yellow, magenta, cyan, and black image data. For example, according to yellow image data, the photoconductor 10 of the process unit 9Y is irradiated with a laser beam. The developing devices 12 supply toner to the electrostatic latent images thus formed on the surface of the photoconductors 10 with the respective drum-shaped developing rollers, rendering the electrostatic latent images visible as toner (or developer) images.

In the transfer device 4, a driver drives and rotates the drive roller 14, thereby rotating the intermediate transfer belt 16 in a counterclockwise direction of rotation A as illustrated in FIG. 1. A power source applies voltage to each of the primary transfer rollers 13. Specifically, each of the primary transfer rollers 13 is supplied with a constant voltage or a constant current control voltage having a polarity opposite a polarity of the charged toner. Accordingly, transfer electric fields are generated at the primary transfer nips. The transfer electric fields thus generated transfer yellow, magenta, cyan, and black toner images from the respective photoconductors 10 onto the intermediate transfer belt 16 such that the yellow, magenta, cyan, and black toner images are sequentially superimposed one atop another on the intermediate transfer belt 16. Thus, a composite full-color toner image is formed on the intermediate transfer belt 16.

In the meantime, as the image forming operation starts, the sheet feeding roller 19 of the sheet feeder 5 is rotated in the lower portion of the image forming apparatus 1, to feed a sheet P from the sheet tray 18 toward the registration roller pair 30 along the conveyance passage 7. Activation of the registration roller pair 30 is timed to send out the sheet P, along the conveyance passage 7, toward the secondary transfer nip between the secondary transfer roller 17 and the drive roller 14 (more specifically, between the secondary transfer roller 17 and the intermediate transfer belt 16) such that the full-color toner image on the intermediate transfer belt 16 meets the sheet P at the secondary transfer nip. The secondary transfer roller 17 is supplied with a transfer voltage having a polarity opposite a polarity of the charged toner contained in the full-color toner image formed on the intermediate transfer belt 16, thereby generating a transfer electric field at the secondary transfer nip. The transfer electric field thus generated transfers the full-color toner image from the intermediate transfer belt 16 onto the sheet P at the secondary transfer nip. Specifically, the yellow, magenta, cyan, and black toner images constructing the composite full-color toner image are transferred onto the sheet P at once.

The sheet P bearing the full-color toner image is conveyed to the fixing device 6, which fixes the toner image onto the sheet P under heat and pressure from the fixing belt 21 and the pressure roller 22. The sheet P bearing the fixed toner image is separated from the fixing belt 21 and conveyed by one or more of the conveyance roller pairs to the sheet ejector 8. The sheet ejection roller pair 31 of the sheet ejector 8 ejects the sheet P onto the output tray 32.

The above describes the image forming operation of the color image forming apparatus 1 to form the full-color toner image on the sheet P. Alternatively, the image forming apparatus 1 may form a monochrome image by using any one of the four process units 9Y, 9M, 9C, and 9K, or may form a bicolor image or a tricolor image by use of two or three of the process units 9Y, 9M, 9C, and 9K, respectively.

Figure 2:
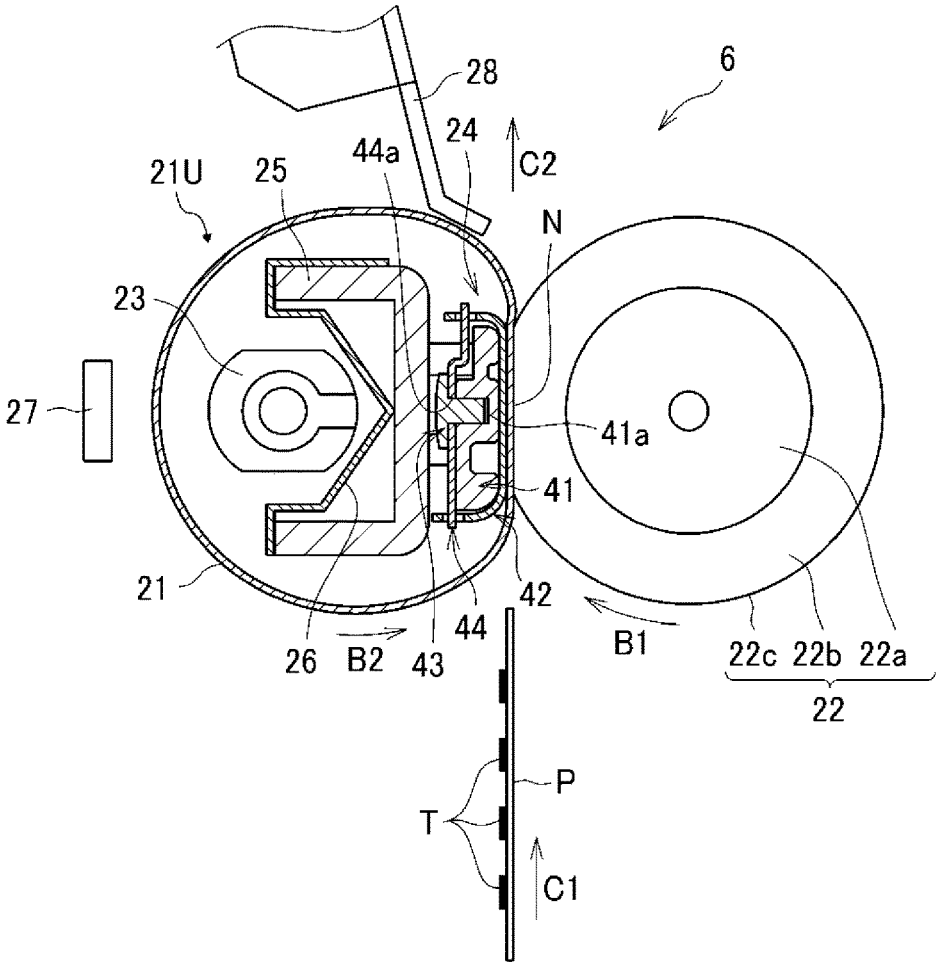
FIG. 2 is a cross-sectional view of a fixing device incorporated in the image forming apparatus of FIG. 1.

Referring now to FIG. 2, a description is given of a configuration of the fixing device 6 incorporated in the image forming apparatus 1 described above. FIG. 2 is a cross-sectional view of the fixing device 6.

As illustrated in FIG. 2, the fixing device 6 includes the fixing belt 21 that is an endless belt formed into a loop, the pressure roller 22, a temperature sensor 27, a separator 28, and various components disposed inside the loop formed by the fixing belt 21, such as a halogen heater 23, a nip formation member 24, a stay 25, and a reflector 26. The fixing belt 21 and the components disposed inside the loop formed by the fixing belt 21 constitute a belt unit 21U, which is detachably coupled to the pressure roller 22. The fixing belt 21 is a rotatable belt member (or fixing member). The pressure roller 22 is an opposed member rotatably disposed opposite an outer circumferential surface of the fixing belt 21. The halogen heater 23 is a heating member that heats the fixing belt 21. As described above, the nip formation member 24 is disposed inside the loop formed by the fixing belt 21. In other words, the nip formation member 24 is disposed opposite an inner circumferential surface of the fixing belt 21 to form an area of contact, herein referred to as a fixing nip N, between the fixing belt 21 and the pressure roller 22. The stay 25 is a contact member that contacts a rear side of the nip formation member 24 to support the nip formation member 24. The reflector 26 reflects light radiating from the halogen heater 23 toward the fixing belt 21. The temperature sensor 27 is a temperature detector that detects the temperature of the fixing belt 21. The separator 28 separates a sheet P from the fixing belt 21. The fixing device 6 further includes a pressurization assembly that presses the pressure roller 22 toward the fixing belt 21.

With continued reference to FIG. 2, a detailed description is now given of the components of the fixing device 6 described above. The fixing belt 21 is a thin, flexible, endless belt member (including a film). Specifically, the fixing belt 21 is constructed of a base layer as the inner circumferential surface of the fixing belt 21 and a release layer as the outer circumferential surface of the fixing belt 21. The base layer is made of metal such as nickel or steel use stainless (SUS). Alternatively, the base layer may be made of resin such as polyimide (PI). The release layer is made of tetrafluoroethylene-perfluoroalkylvinylether copolymer (PFA), polytetrafluoroethylene (PTFE), or the like. Optionally, an elastic layer made of rubber such as silicone rubber, silicone rubber foam, or fluoro rubber may be interposed between the base layer and the release layer.

The pressure roller 22 is constructed of a core 22*a*, an elastic layer 22*b* resting on the core 22*a*, and a release layer 22*c* resting on the elastic layer 22*b*. The elastic layer 22*b* is made of silicone rubber foam, silicone rubber, fluoro rubber, or the like. The release layer 22*c* is made of PFA, PTFE, or the like. The pressurization assembly presses the pressure roller 22 against the nip formation member 24 via the fixing belt 21. Thus, the pressure roller 22 contacts the nip formation member 24 via the fixing belt 21. The pressure roller 22 in pressure contact with the fixing belt 21 deforms the elastic layer 22*b* of the pressure roller 22, thus defining the fixing nip N having a predetermined width, which is a predetermined length in the sheet conveying direction, between the fixing belt 21 and the pressure roller 22. A driver such as a motor situated inside the image forming apparatus 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 in accordance with rotation of the pressure roller 22 by friction between the fixing belt 21 and the pressure roller 22.

In the present embodiment, the pressure roller 22 is a solid roller. Alternatively, the pressure roller 22 may be a hollow roller, i.e., a tube. In a case in which the pressure roller 22 is a hollow roller, a heat source such as a halogen heater may be disposed inside the pressure roller 22.

In a case in which the fixing belt 21 does not incorporate the elastic layer, the fixing belt 21 has a decreased thermal capacity that improves fixing property of being heated quickly to a desired fixing temperature at which a toner image is fixed onto a sheet P. However, as the fixing belt 21 and the pressure roller 22 sandwich and press an unfixed toner image onto the sheet P, slight surface asperities in the fixing belt 21 may be transferred onto the toner image on the sheet P, resulting in variation in gloss of a solid portion of the toner image fixed onto the sheet P. To address such a situation, the fixing belt 21 preferably incorporate an elastic layer having a thickness not smaller than 100 μm. The elastic layer having a thickness not smaller than 100 μm elastically deforms to absorb the slight surface asperities in the fixing belt 21, thus preventing the variation in gloss of the toner image on the sheet P. The elastic layer 22*b* of the pressure roller 22 may be made of solid rubber. Alternatively, in a case in which no heat source is situated inside the pressure roller 22, the elastic layer 22*b* may be made of sponge rubber. The sponge rubber is preferable to the solid rubber because the sponge rubber has enhanced thermal insulation that draws less heat from the fixing belt 21. According to the present embodiment, the pressure roller 22 serving as an opposed member is pressed against the fixing belt 21 serving as a fixing member. Alternatively, the pressure roller 22 may merely contact the fixing belt 21 with no pressure exerted between the fixing belt 21 and the pressure roller 22.

Opposed longitudinal end portions of the halogen heater 23 are secured to side plates of the fixing device 6, respectively. The power source situated inside the image forming apparatus 1 supplies power to the halogen heater 23 so that the halogen heater 23 generates heat. Specifically, a controller (e.g., a processor), that is, a central processing unit (CPU) provided with a random-access memory (RAM) and a read-only memory (ROM), for example, is operatively connected to the power source and the temperature sensor 27 to control the power supply to the halogen heater 23 based on the temperature of the outer circumferential surface of the fixing belt 21 detected by the temperature sensor 27. Such heating control of the halogen heater 23 adjusts the temperature of the fixing belt 21 to a desired fixing temperature. As a heating member that heats the fixing belt 21, an induction heater (IH), a resistive heat generator, a carbon heater, or the like may be employed instead of the halogen heater 23.

The nip formation member 24 is elongated in a width direction of the fixing belt 21 (hereinafter referred to as an axial direction of the fixing belt 21) parallel to an axial direction of the pressure roller 22. In short, the nip formation member 24 is elongated axially along the fixing belt 21 and the pressure roller 22. The axial direction of the fixing belt 21 or the axial direction of the pressure roller 22 is a direction perpendicular to a surface of the paper on which FIG. 2 is drawn. That is, a longitudinal direction of the nip formation member 24 is parallel to the axial direction of the fixing belt 21 and the axial direction of the pressure roller 22. The nip formation member 24 is secured to and supported by the stay 25. As the nip formation member 24 receives pressure from the pressure roller 22, the stay 25 prevents the nip formation member 24 from being bent by such pressure. Accordingly, the fixing nip N is formed retaining an even width axially along the pressure roller 22. Specifically, the fixing nip N retains an even length in the sheet conveying direction throughout an entire width of the pressure roller 22 in the axial direction of the pressure roller 22. A detailed description of the nip formation member 24 is deferred.

The stay 25 is elongated longitudinally along the nip formation member 24. The stay 25 contacts the rear side of the nip formation member 24 longitudinally along the nip formation member 24 to support the nip formation member 24 against the pressure from the pressure roller 22. Preferably, the stay 25 is made of metal exhibiting enhanced mechanical strength, such as stainless steel or iron, to prevent bending of the nip formation member 24. Alternatively, the stay 25 may be made of resin.

The reflector 26 is interposed between the stay 25 and the halogen heater 23. In the present embodiment, the reflector 26 is secured to the stay 25. The reflector 26 is made of aluminum, stainless steel, or the like. The reflector 26 thus disposed reflects, to the fixing belt 21, the light radiating from the halogen heater 23 toward the stay 25. Such reflection by the reflector 26 increases an amount of light that irradiates the fixing belt 21, thereby heating the fixing belt 21 efficiently. In addition, the reflector 26 restrains conduction of radiation heat from the halogen heater 23 to the stay 25 and the like, thus saving energy.

In a case in which the fixing device 6 excludes the reflector 26 of the present embodiment, a heater-side surface of the stay 25 opposite the halogen heater 23 may be given a mirror finish by polishing or coating, to be a reflection surface that reflects radiation heat or light from the halogen heater 23 to the fixing belt 21. Preferably, the reflector 26 or the reflection surface of the stay 25 has a reflectance of 90% or greater.

However, since the shape and material of the stay 25 are limited to retain the mechanical strength of the stay 25, the reflector 26 is preferably disposed together with the stay 25 as in the fixing device 6 of the present embodiment. The reflector 26 disposed together with the stay 25 increases flexibility in selection of the shape and material of the stay 25, attaining properties peculiar to the stay 25 and the reflector 26, respectively. As illustrated in FIG. 2, the reflector 26 is interposed between the halogen heater 23 and the stay 25. That is, the reflector 26 is positioned near the halogen heater 23. The reflector 26 thus positioned allows the halogen heater 23 to heat the fixing belt 21 efficiently.

In order to further enhance the efficiency of heating the fixing belt 21 by light reflection, the direction of the reflector 26 or the reflection surface of the stay 25 is to be considered. For example, when the reflector 26 is disposed concentrically with the halogen heater 23 as the center, the reflector 26 reflects light toward the halogen heater 23, resulting in a decrease in heating efficiency. By contrast, when a part or all of the reflector 26 is disposed in a direction to reflect light toward the fixing belt 21, other than a direction to reflect light toward the halogen heater 23, the reflector 26 reflects less light toward the halogen heater 23, thereby enhancing the efficiency of heating the fixing belt 21 by the reflected light.

A description is now given of various structural advantages of the fixing device 6 to enhance energy saving and shorten a first print time taken to output the sheet P bearing the fixed toner image upon receipt of a print job through preparation for a print operation and the subsequent print operation.

For example, the fixing device 6 employs a direct heating method in which the halogen heater 23 directly heats the fixing belt 21 in a circumferential direct heating span on the fixing belt 21 other than the fixing nip N. According to the present embodiment, no component is interposed between a left side of the halogen heater 23 and the fixing belt 21 in FIG. 2 such that the halogen heater 23 radiates heat directly to the circumferential direct heating span on the fixing belt 21.

In order to decrease the thermal capacity of the fixing belt 21, the fixing belt 21 is thin and has a decreased loop diameter. Specifically, for example, the base layer of the fixing belt 21 has a thickness in a range of from 20 μm to 50 μm. The elastic layer of the fixing belt 21 has a thickness in a range of from 100 μm to 300 μm. The release layer of the fixing belt 21 has a thickness in a range of from 10 μm to 50 μm. Thus, the fixing belt 21 has a total thickness not greater than 1 mm. The loop diameter of the fixing belt 21 is in a range of from 20 mm to 40 mm. In order to further decrease the thermal capacity, the fixing belt 21 may preferably have a total thickness not greater than 0.2 mm, and more preferably, not greater than 0.16 mm. Preferably, the loop diameter of the fixing belt 21 may not be greater than 30 mm.

Note that, according to the present embodiment, the pressure roller 22 has a diameter in a range of from 20 mm to 40 mm. That is, the loop diameter of the fixing belt 21 is equivalent to the diameter of the pressure roller 22. However, the loop diameter of the fixing belt 21 and the diameter of the pressure roller 22 are not limited to the sizes described above. For example, the loop diameter of the fixing belt 21 may be smaller than the diameter of the pressure roller 22. In this case, at the fixing nip N, the fixing belt 21 has a curvature greater than a curvature of the pressure roller 22. Such a greater curvature of the fixing belt 21 facilitates separation of the sheet P (i.e., recording medium) from the fixing belt 21 when the sheet P is ejected from the fixing nip N.

With continued reference to FIG. 2, a description is now given of a fixing operation of the fixing device 6 according to the present embodiment.

As the image forming apparatus 1 illustrated in FIG. 1 is powered on, the halogen heater 23 is supplied with power; whereas the driver starts driving and rotating the pressure roller 22 in a clockwise direction of rotation B1 as illustrated in FIG. 2. The rotation of the pressure roller 22 drives the fixing belt 21 to rotate in a counterclockwise direction of rotation B2 as illustrated in FIG. 2 by friction between the fixing belt 21 and the pressure roller 22.

Thereafter, a sheet P bearing an unfixed toner image T formed in the image forming operation or process described above is conveyed in a direction C1 as illustrated in FIG. 2 while being guided by a guide plate. The sheet P then enters the fixing nip N formed between the fixing belt 21 and the pressure roller 22 pressed against the fixing belt 21. The toner image T is fixed onto the sheet P under heat from the fixing belt 21 heated by the halogen heater 23 and pressure exerted between the fixing belt 21 and the pressure roller 22.

The sheet P bearing the fixed toner image T is sent out from the fixing nip N and conveyed in a direction C2 as illustrated in FIG. 2. As a leading edge of the sheet P contacts a front edge of the separator 28, the separator 28 separates the sheet P from the fixing belt 21. The sheet P thus separated is then ejected by the sheet ejection roller pair 31 illustrated in FIG. 1 outside the housing of the image forming apparatus 1. Thus, a plurality of sheets P lie stacked on the output tray 32 atop the housing of the image forming apparatus 1.

Figure 3:
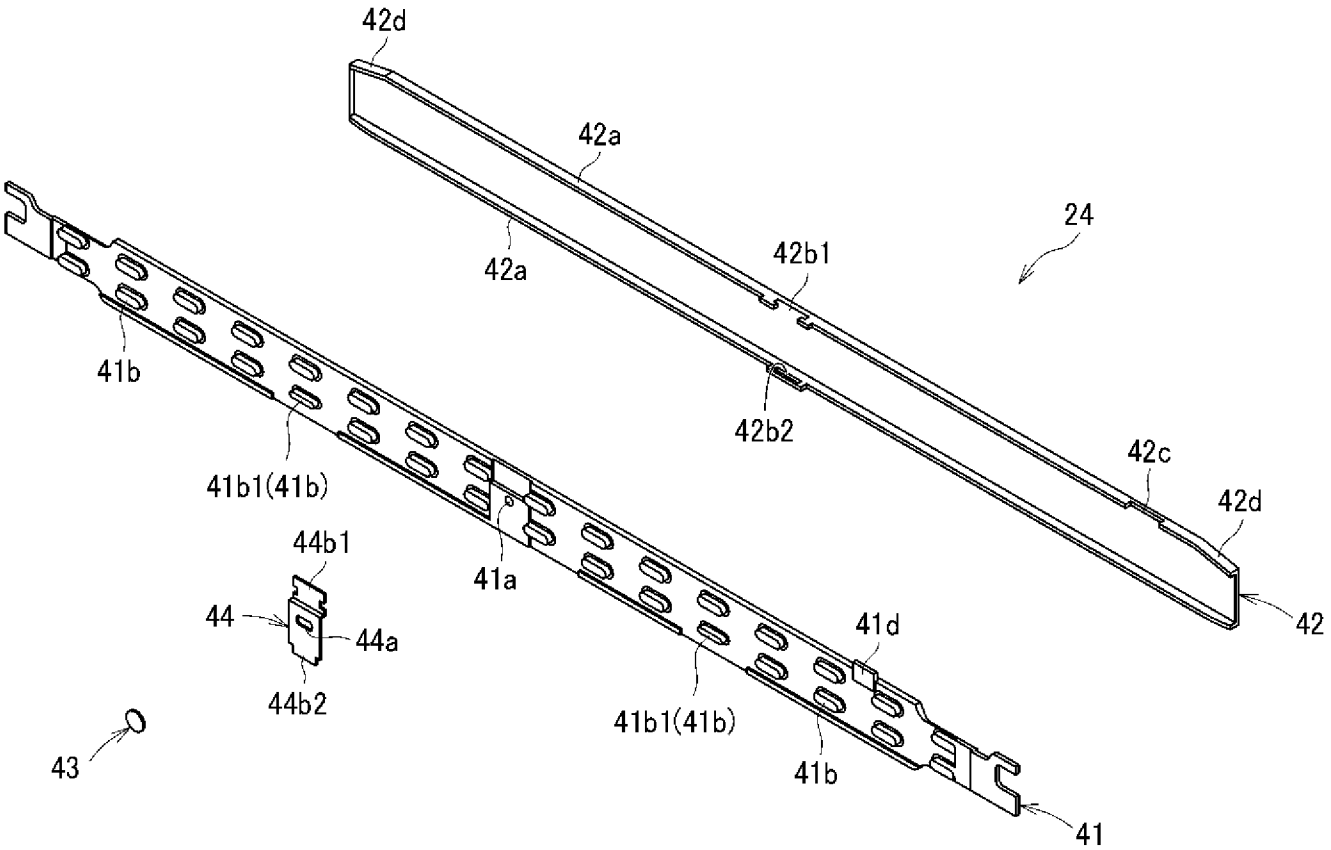
FIG. 3 is an exploded, perspective view of a nip formation member incorporated in the fixing device of FIG. 2.

Referring now to FIGS. 2 and 3, a detailed description is given of the nip formation member 24 incorporated in the fixing device 6 described above. FIG. 3 is an exploded, perspective view of the nip formation member 24.

As illustrated in FIGS. 2 and 3, the nip formation member 24 includes a base 41, a thermal equalization member 42 serving as a high thermal conduction member, a screw 43 serving as a fastener, and a securing member 44 that fastens the screw 43. The base 41 and the thermal equalization member 42 extend in the longitudinal direction of the nip formation member 24.

The base 41 is made of a heat-resistant material such as an inorganic substance, rubber, resin, or a combination thereof. Examples of the inorganic substance include ceramic, glass, and aluminum. Examples of the rubber include silicone rubber and fluororubber. An example of the resin is fluororesin such as PTFE, PFA, ethylene tetrafluoroethylene (ETFE), and tetrafluoroethylene-hexafluoropropylene copolymer (FEP). Other examples of the resin include PI, polyamide imide (PAI), polyphenylene sulfide (PPS), polyether ether ketone (PEEK), liquid crystal polymer (LCP), phenolic resin, nylon and aramid.

In the present embodiment, the base 41 is an LCP having enhanced heat resistance and moldability. The base 41 has a thermal conductivity of, e.g., 0.54 in watts per meter-kelvin (W/(m K)).

The base 41 has a fastening hole 41*a* in a longitudinal center portion of the base 41. The base 41 is fastened to the securing member 44 through the fastening hole 41*a*. The fastening hole 41*a* is provided partway through the base 41 in a thickness direction of the base 41. That is, the fastening hole 41*a* is not a through or open hole.

As illustrated in FIG. 3, the base 41 includes a plurality of projections 41*b* projecting toward the stay 25. Specifically, the plurality of projections 41*b* includes projections 41*b* arranged in a longitudinal direction of the base 41 in two lines in a transverse direction of the base 41. The plurality of projections 41*b* contacts the stay 25 serving as a contact member disposed opposite the nip formation member 24, to position the nip formation member 24 relative to the stay 25. Thus, the plurality of projections 41*b* serves as a positioner.

The thermal equalization member 42 contacts the inner circumferential surface of the fixing belt 21 as illustrated in FIG. 2. The thermal equalization member 42 is made of a material having a thermal conductivity greater than a thermal conductivity of the base 41. Specifically, in the present embodiment, the thermal equalization member 42 is made of SUS having a thermal conductivity in a range of from 16.7 to 20.9 W/(m K). Alternatively, the thermal equalization member 42 may be made of a material having a relatively high thermal conductivity, such as a copper-based material having a thermal conductivity of, e.g., 381 W/(m K) or an aluminum-based material having a thermal conductivity of, e.g., 236 W/(m K).

The thermal equalization member 42 having a good thermal conductivity is disposed on a fixing-belt side of the nip formation member 24 opposite the fixing belt 21, so as to contact the fixing belt 21 axially along the fixing belt 21, that is, throughout an entire width of the fixing belt 21 in the axial direction of the fixing belt 21. The thermal equalization member 42 thus disposed conducts and equalizes heat on the fixing belt 21 in the axial direction of the fixing belt 21. In other words, the thermal equalization member 42 eliminates the axial temperature unevenness of the fixing belt 21.

The thermal equalization member 42 includes bent portions 42*a* longitudinally along the thermal equalization member 42 on opposed transverse sides of the thermal equalization member 42, respectively. In the present embodiment, the bent portions 42*a* of the thermal equalization member 42 are opposed transverse sides of a metal plate (i.e., upper and lower sides of the thermal equalization member 42 in FIG. 2) bent substantially perpendicular to a transverse direction of the metal plate (i.e., in a leftward direction away from the fixing nip N in FIG. 2).

As illustrated in FIG. 3, in the present embodiment, the thermal equalization member 42 has a first insertion hole 42*b*1 and a second insertion hole 42*b*2 in the respective longitudinal middles of the bent portions 42*a*, on the opposed transverse sides of the thermal equalization member 42. Insertion portions of the securing member 44 are inserted into the first insertion hole 42*b*1 and the second insertion hole 42*b*2 of the thermal equalization member 42, respectively. A detailed description of the insertion portions of the securing member 44 is deferred. The first insertion hole 42*b*1 and the second insertion hole 42*b*2 open in a transverse direction of the thermal equalization member 42 (i.e., vertical direction in FIG. 2). As illustrated in FIG. 3, the portions where the first insertion hole 42*b*1 and the second insertion hole 42*b*2 are provided in the bent portions 42*a* are shaped partially projecting in the direction in which the thermal equalization member 42 is bent away from the fixing nip N, beyond other portions of the bent portions 42*a*. The first insertion hole 42*b*1 is shaped opening in a thickness direction of the thermal equalization member 42.

The thermal equalization member 42 includes converging portions 42*d* on opposed longitudinal end portions of the thermal equalization member 42, respectively. The converging portions 42*d* narrow the thermal equalization member 42 in the transverse direction of the thermal equalization member 42 toward opposed longitudinal edges of the thermal equalization member 42, respectively.

The securing member 44, independent from the base 41 and the thermal equalization member 42, secures the base 41 and the thermal equalization member 42 to each other. The securing member 44 has a fastening hole 44*a* in the middle of the securing member 44. The screw 43 is inserted through the fastening hole 44*a*, thus being fixed. As described above, the securing member 44 includes a first insertion portion 44*b*1 and a second insertion portion 44*b*2 on opposed sides (in this case, opposed longitudinal end portions) of the securing member 44, respectively.

Figure 4A:
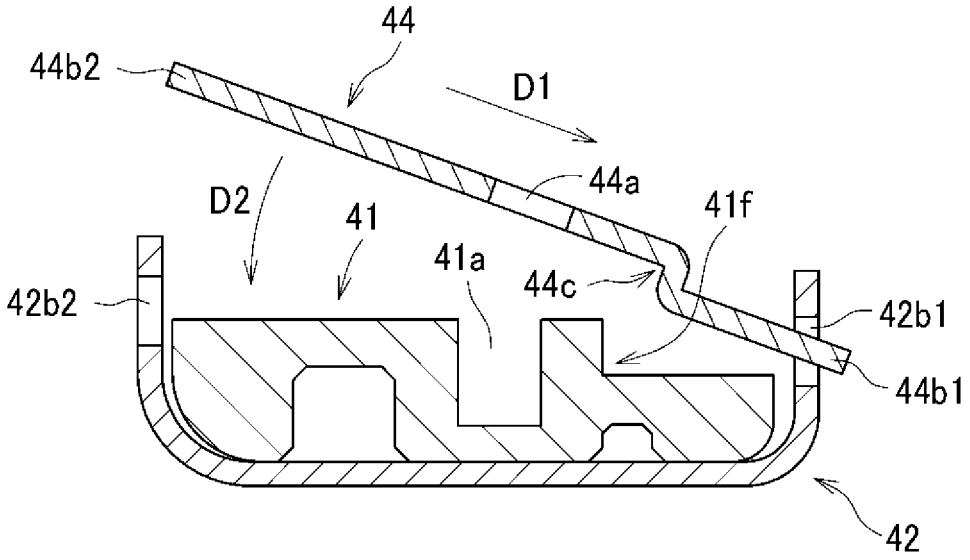
FIGS. 4A and 4B (FIG. 4) are cross-sectional views of a securing member and a thermal equalization member, illustrating how the securing member is attached to the thermal equalization member.
Figure 4B:
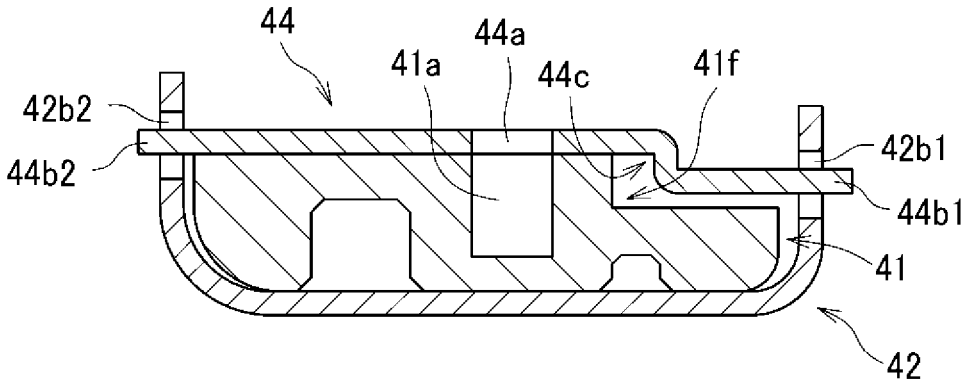
Figure 5:
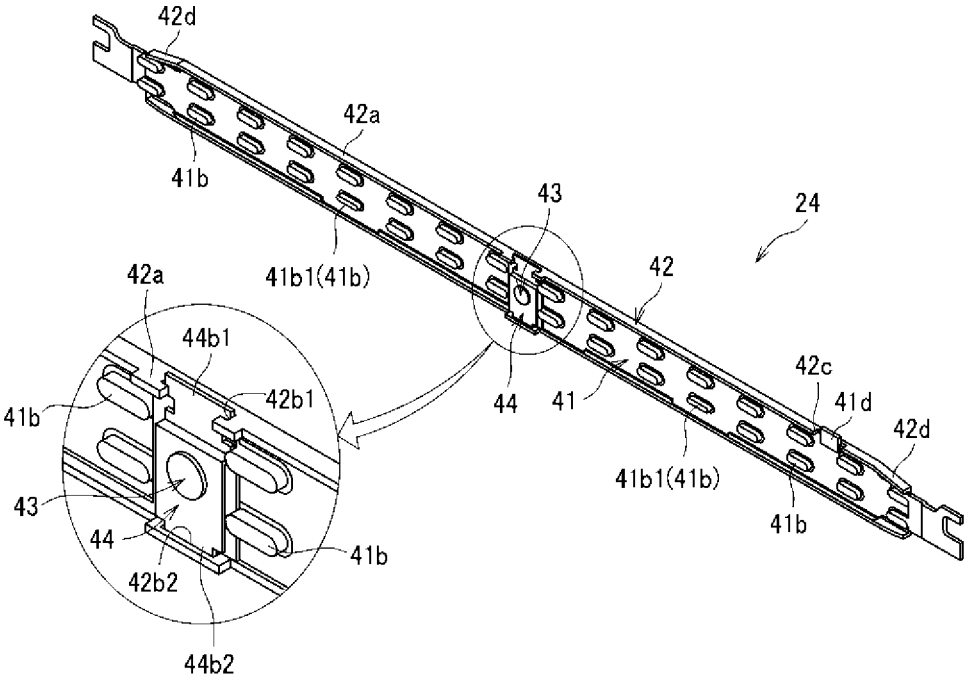
FIG. 5 is a perspective view of the nip formation member.

Referring now to FIGS. 4 and 5, a description is given of how to assembly the components described above. FIGS. 4A and 4B (FIG. 4) are cross-sectional views of the securing member 44 and the thermal equalization member 42, illustrating how the securing member 44 is attached to the thermal equalization member 42. FIG. 5 is a perspective view of the nip formation member 24.

First, the base 41 is inserted into a recess defined by the bent portions 42*a* on the opposed transverse sides of the thermal equalization member 42. In this state, as illustrated in FIG. 4A, the securing member 44 is inclined with respect to the thermal equalization member 42. The first insertion portion 44*b*1 of the securing member 44 is then inserted into the corresponding first insertion hole 42*b*1 of the thermal equalization member 42 in a direction D1 as illustrated in FIG. 4A. Thereafter, one side of the securing member 44 on which the second insertion portion 44*b*2 is located is tilted toward the thermal equalization member 42 in a direction D2 as illustrated in FIG. 4A. The securing member 44 is then slightly slid to the left in FIG. 4A so that the second insertion portion 44*b*2 of the securing member 44 is inserted into the corresponding second insertion hole 42*b*2 of the thermal equalization member 42. As a consequence, as illustrated in FIG. 4B, the securing member 44 is disposed on the base 41 and attached to the thermal equalization member 42. Alternatively, the second insertion portion 44*b*2 may be inserted into the corresponding second insertion hole 42*b*2 before the first insertion portion 44*b*1 is inserted into the corresponding first insertion hole 42*b*1. In the cross section in a longitudinal direction of the securing member 44 illustrated in FIG. 4B, the base 41 is sandwiched between the thermal equalization member 42 and the securing member 44 with the first and second insertion portions 44*b*1 and 44*b*2 inserted in the first and second insertion holes 42*b*1 and 42*b*2, respectively. In other words, the securing member 44 is disposed opposite the thermal equalization member 42 via the base 41 with the first and second insertion portions 44*b*1 and 44*b*2 inserted in the first and second insertion holes 42*b*1 and 42*b*2, respectively.

The screw 43 is driven into the fastening hole 44*a* of the securing member 44 and further into the fastening hole 41*a* of the base 41, thereby fastening the securing member 44 and the base 41 to each other. Accordingly, as illustrated in FIG. 5, the nip formation member 24 is assembled with the base 41 and the thermal equalization member 42 secured to each other.

As described above, in the present embodiment, the securing member 44 is attached to the thermal equalization member 42 while being fastened to the base 41 by the screw 43. Thus, the securing member 44 secures and positions the base 41 and the thermal equalization member 42 to each other. In other words, the screw 43 secures the securing member 44 attached to the thermal equalization member 42 to the base 41. Specifically, as the first insertion portion 44*b*1 and the second insertion portion 44*b*2 of the securing member 44 are inserted in the first insertion hole 42*b*1 and the second insertion hole 42*b*2 of the thermal equalization member 42, respectively, the movement of the securing member 44 relative to the thermal equalization member 42 is restricted in the longitudinal and thickness directions of the thermal equalization member 42. That is, the securing member 44 fastened to the base 41 restricts the movement of the base 41 relative to the thermal equalization member 42 in the longitudinal and thickness directions of the thermal equalization member 42. In addition, a transverse movement of the base 41 is restricted by the bent portions 42*a* on the opposed transverse sides of the thermal equalization member 42. Accordingly, the movement of the base 41 relative to the thermal equalization member 42 is restricted in each of the above-described directions. In other words, the base 41 and the thermal equalization member 42 are secured to each other. In the present embodiment, the bent portions 42*a* are provided throughout the length of the thermal equalization member 42. Alternatively, the bent portions 42*a* may be partially provided in a longitudinal direction of the thermal equalization member 42. For example, the bent portions 42*a* may be provided simply at the opposed longitudinal end portions of the thermal equalization member 42. The advantages described above are obtainable in such a case.

Since the base 41 and the thermal equalization member 42 are secured o each other by another component (i.e., securing member 44), the present embodiment increases the structural flexibility for securing and positioning the base 41 and the thermal equalization member 42 to each other, compared with a case in which a base and a thermal equalization member are structurally secured and positioned to each other by, e.g., a direct engagement of the base and the thermal equalization member.

In addition, using such another component omits use of a base and a thermal equalization member having a complicated shape with, e.g., a claw for engagement. In other words, according to the present embodiment, the base 41 and the thermal equalization member 42 have a simple configuration. For example, unlike the present embodiment, a thermal equalization member may be shaped including claws on opposed transverse sides of the thermal equalization member, respectively, to hold and be engaged with a base. In such a case, for example, a metal plate may be bent a plurality of times to form the claws. That is, the formation of the metal plate (i.e., thermal equalization member) is complicated and degraded in accuracy. By contrast, in the present embodiment, the opposed transverse sides of the metal plate is bent once to shape the bent portions 42*a* of the thermal equalization member 42, thus enhancing the accuracy of formation of the thermal equalization member 42.

Due to such advantages, in the present embodiment, the base 41 and the thermal equalization member 42 are accurately positioned relative to each other. In a case in which a base and a thermal equalization member are insufficiently secured to each other and misaligned, the thermal equalization member may not contact axial ends of a fixing belt in an image forming area, for example. In such a case, the thermal equalization member may fail to sufficiently exhibit effective thermal equalization in the image forming area of the fixing belt, resulting in an image fixing failure. In a case in which a thermal equalization member is inclined with respect to a base in, e.g., a longitudinal direction of the base, the shape of a fixing nip is distorted. As a consequence, the position at which a sheet ejected from the fixing nip is separated from the fixing belt is deviated in an axial direction of the fixing belt, thereby causing wrinkles on the sheet or a paper jam. By contrast, in the present embodiment, the base 41 and the thermal equalization member 42 are accurately positioned relative to each other, thereby preventing such unfavorable situations.

Relatedly, as the fixing belt 21 rotates, the fixing belt 21 slides over the nip formation member 24. That is, the part securing the base 41 and the thermal equalization member 42 burdens a load generated when the fixing belt 21 slides over the nip formation member 24. However, in the present embodiment, the screw 43 fastens the securing member 44 to the base 41. Such a configuration is mechanically advantageous compared with a case in which a base and a thermal equalization member are structurally secured to each other by, e.g., engagement with each other with claws.

In the present embodiment, as illustrated in FIGS. 4A and 4B (FIG. 4), the base 41 has a step portion 41*f* on a side opposite the securing member 44. Similarly, the securing member 44 has a step portion 44*c* on a side opposite the base 41. The step portions 41*f* and 44*c* are shaped corresponding to each other. In other words, the securing member 44 and the base 41 have steps (i.e., step portions 44*c* and 410 shaped corresponding to each other. The step portions 41*f* and 44*c* facilitate attachment of the securing member 44 to the base 41. In addition, the securing member 44 is shaped with asymmetrical front and rear sides in a transverse direction of the securing member 44. Such a shape of the securing member 44 prevents the securing member 44 from being attached incorrectly, e.g., upside down and inside out.

Figure 6:
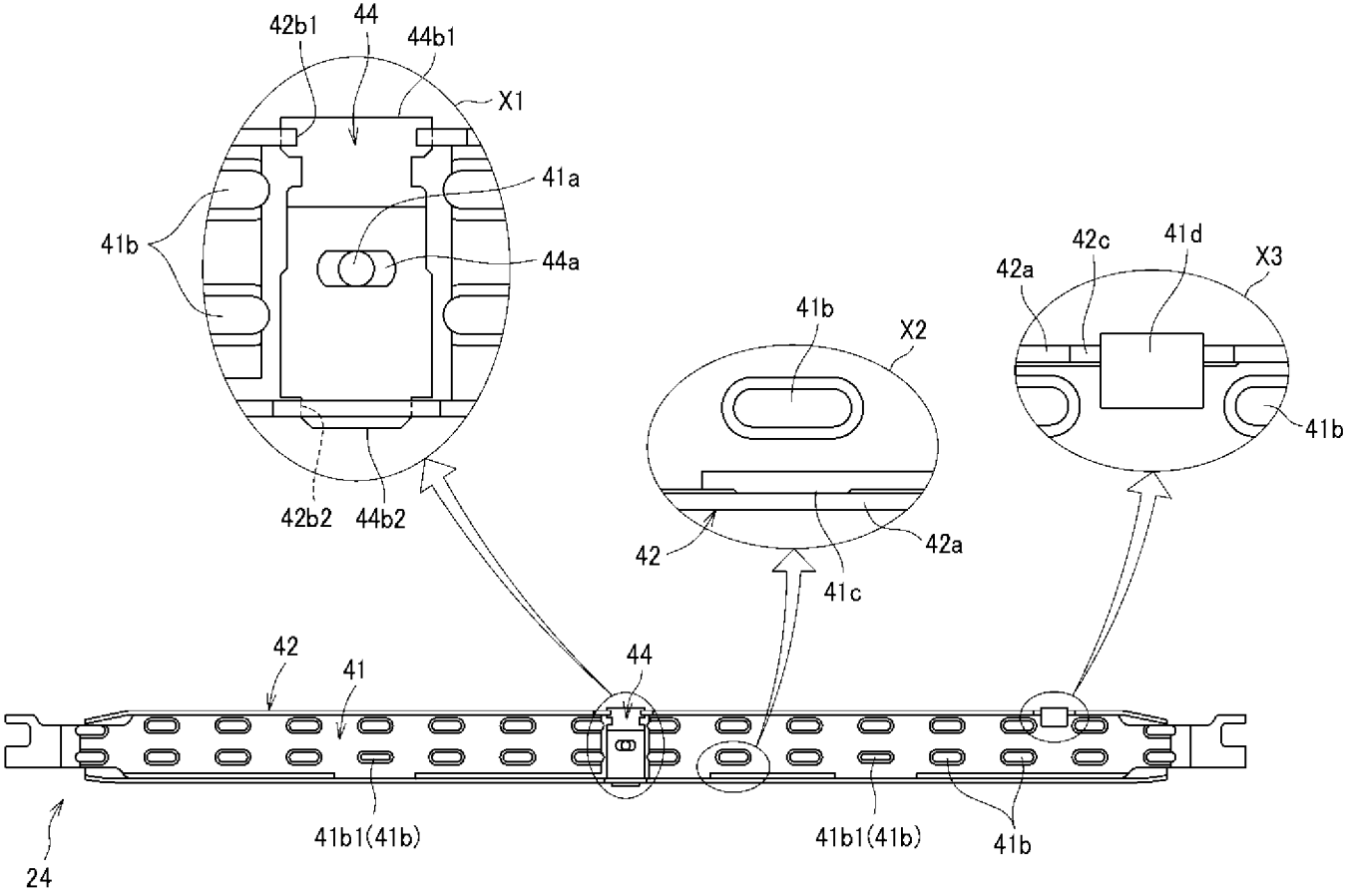
FIG. 6 is a plan view of the nip formation member.

In addition, as illustrated in FIG. 6, the securing member 44 is attached and secured by the screw 43 to the respective longitudinal middles of the base 41 and the thermal equalization member 42, thus positioning the base 41 and the thermal equalization member 42 relative to the longitudinal middle of each other. Accordingly, the base 41 and the thermal equalization member 42 are less likely to be shifted to one side in the respective longitudinal directions of the base 41 and the thermal equalization member 42. Such a configuration eliminates the axial temperature unevenness of the fixing belt 21 and the pressure deviation at the fixing nip N in the axial direction of the fixing belt 21. Note that each of the longitudinal center portion of the base 41 and the thermal equalization member 42 corresponds to a center area of three longitudinal areas into which each of the base 41 and the thermal equalization member 42 is divided. Most preferably, the respective longitudinal centers of the base 41 and the thermal equalization member 42 are secured to each other.

In the present embodiment, the base 41 is made of resin; whereas the thermal equalization member 42 is made of metal. In other words, the base 41 and the thermal equalization member 42 are made of different materials and having different coefficients of thermal expansion from each other. Specifically, the base 41 and the thermal equalization member 42 exhibit different coefficients of thermal expansion caused by the heat from the halogen heater 23. Since respective longitudinal center points of the base 41 and the thermal equalization member 42 are secured to each other, the base 41 and the thermal equalization member 42 release the expanded amounts to opposed longitudinal sides of the base 41 and the thermal equalization member 42, respectively, thus preventing damage to the thermal equalization member 42 in particular.

In the present embodiment, when the first insertion portion 44*b*1 of the securing member 44 is inserted into the corresponding first insertion hole 42*b*1 of the thermal equalization member 42 in the direction D1 as illustrated in FIG. 4A, the securing member 44 is guided by side walls of the projections 41*b* positioned on both sides of the securing member 44 in an insertion direction (i.e., from one side to the other side in a transverse direction of the nip formation member 24 as illustrated in FIG. 6), thus being attached to the base 41. In short, the projections 41*b* (particularly the side walls of the projections 41*b*) serve as guides. Such a configuration facilitates the insertion of the securing member 44 into the first insertion hole 42*b*1 and the second insertion hole 42*b*2 of the thermal equalization member 42. Alternatively, instead of the projections 41*b*, ribs extending from one side to the other side in the transverse direction of the base 41 may be provided as guides at the positions corresponding to the projections 41*b*.

Referring now to FIG. 6, a detailed description is given of how the base 41 and the thermal equalization member 42 are secured to each other with the securing member 44. FIG. 6 is a plan view of the nip formation member 24. As illustrated in an enlarged view X1 of FIG. 6, the first insertion portion 44*b*1 and the second insertion portion 44*b*2 of the securing member 44 are inserted in the first insertion hole 42*b*1 and the second insertion hole 42*b*2 of the thermal equalization member 42, respectively, thereby being positioned relative to the thermal equalization member 42 in a lateral direction in FIG. 6. Specifically, as longitudinal end portions of the first insertion portion 44*b*1 and longitudinal end portions of the second insertion portion 44*b*2 contact side walls that define the first insertion hole 42*b*1 and the second insertion hole 42*b*2, respectively, a lateral movement of the securing member 44 relative to the thermal equalization member 42 is restricted in FIG. 6. Accordingly, the base 41 fastened to the securing member 44 is positioned relative to the thermal equalization member 42 in the longitudinal direction of the thermal equalization member 42. In the present embodiment, the widths or dimensions of the first and second insertion holes 42*b*1 and 42*b*2 and the widths or dimensions of the first and second insertion portions 44*b*1 and 44*b*2 are determined so as to minimize the backlash in consideration of, e.g., the dimensional error between the first and second insertion holes 42*b*1 and 42*b*2 and the first and second insertion portions 44*b*1 and 44*b*2.

In the present embodiment, the length of the securing member 44 is determined to minimize the amount of projection of the first insertion portion 44*b*1 from the first insertion hole 42*b*1 upwards in FIG. 6 and the amount of projection of the second insertion portion 44*b*2 from the second insertion hole 42*b*2 downwards in FIG. 6. That is, excessive amounts of projection of the first insertion portion 44*b*1 and the second insertion portion 44*b*2 might interfere with the fixing belt 21 and other components. By contrast, an excessively decreased length of the securing member 44 might hamper the first insertion portion 44*b*1 and the second insertion portion 44*b*2 to reach the first insertion hole 42*b*1 and the second insertion hole 42*b*2 on the opposed transverse sides of the thermal equalization member 42, respectively. In the present embodiment, in consideration of the dimensional error of the thermal equalization member 42 and the securing member 44, the respective sizes of the thermal equalization member 42 and the securing member 44 are determined to minimize the amounts of projection of the first insertion portion 44*b*1 and the second insertion portion 44*b*2 and ensure the insertion of the first insertion portion 44*b*1 and the second insertion portion 44*b*2 into the first insertion hole 42*b*1 and the second insertion hole 42*b*2, respectively.

Referring back to FIG. 2, the fixing belt 21 rotates upwards at the fixing nip N in FIG. 2. The rotation of the fixing belt 21 pulls upwards in FIG. 2 the thermal equalization member 42 over which the fixing belt 21 rotates. In other words, the rotation of the fixing belt 21 pulls the thermal equalization member 42 downstream in sheet conveying direction. As a consequence, the thermal equalization member 42 may contact the base 41 on an upstream side of the thermal equalization member 42 in the sheet conveying direction (i.e., lower side in FIG. 2).

To address such a situation, in the present embodiment, the base 41 includes contact portions 41*c* on a first transverse side of the base 41, which is an upstream side (i.e., lower side in FIG. 2) of the base 41 in the sheet conveying direction, as illustrated in an enlarged view X2 of FIG. 6. In addition, the base 41 may include the contact portions 41*c* on a second transverse side of the base 41, which is a downstream side (i.e., upper side in FIG. 2) of the base 41 in the sheet conveying direction. Specifically, in the example of FIG. 6, the base 41 includes the contact portions 41*c* as partial portions projecting upstream in the sheet conveying direction in the longitudinal direction of the base 41. The contact portions 41*c* are situated at four positions. In other words, first to fourth contact portions 41*c* are situated in the longitudinal direction of the base 41. The first and second contact portions 41*c* are provided at opposed longitudinal end portions of the base 41, respectively. Inside the first and second contact portions 41*c* are the third and fourth contact portions 41*c*. The third contact portion 41*c* is situated as illustrated in the enlarged view X2. The fourth contact portion 41*c* is situated across the longitudinal middle of the base 41 from the third contact portions 41*c*. The contact portions 41*c* determines the relative positions of the base 41 and the thermal equalization member 42 in the sheet conveying direction. In particular, the contact portions 41*c* are provided as partial upstream projections on the upstream side of the base 41 in the sheet conveying direction to contact the thermal equalization member 42. Such a configuration limits the positions at which the base 41 and the thermal equalization member 42 contact each other, thus reducing an area of contact between the base 41 and the thermal equalization member 42. Accordingly, the base 41 draws less heat from the thermal equalization member 42, thereby reducing a heat loss of the fixing belt 21. As described above, in the present embodiment, two contact portions 41*c* (i.e., first and second contact portions 41*c*) are provided on the opposed longitudinal end portions of the base 41, respectively. That is, the base 41 and the thermal equalization member 42 contact each other at two farthest-apart positions in the respective longitudinal directions of the base 41 and the thermal equalization member 42. Accordingly, the base 41 and the thermal equalization member 42 stably contact each other.

As illustrated in an enlarged view X3 of FIG. 6, the base 41 includes a projection 41*d*, projecting downstream in the sheet conveying direction, on one longitudinal side of the base 41 and on the second transverse side of the base 41. As described above, the second transverse side of the base 41 is the downstream side of the base 41 in the sheet conveying direction. On the other hand, the thermal equalization member 42 has a slit 42*c* at a position corresponding to the projection 41*d* of the base 41. The slit 42*c* is a partial cut portion of the bent portion 42*a*. The projection 41*d* projects downstream (upwards in FIG. 6) beyond an edge of the thermal equalization member 42. The slit 42*c* is a relief portion to avoid contact between the projection 41*d* and the bent portion 42*a*.

The projection 41*d* and the slit 42*c* prevent an incorrect assembly of the base 41 and the thermal equalization member 42. Specifically, upon an attempt to attach the base 41 to the thermal equalization member 42 inside out or upside down in FIG. 6, the projection 41*d* fails to be situated at the position of the slit 42*c*. That is, the projection 41*d* contacts the bent portion 42*a* of the thermal equalization member 42, thus hampering the assembly of the base 41 and the thermal equalization member 42. In other words, the projection 41*d* in contact with the bent portion 42*a* prevents an assembly of the base 41 and the thermal equalization member 42 in an incorrect direction.

Particularly, in the present embodiment, the base 41 includes the projection 41*d*; whereas the thermal equalization member 42 has the slit 42*c* as a partial cut portion of the bent portion 42*a*. In short, changes in the thermal equalization member 42 is reduced in the present embodiment. In addition, the present embodiment reduces the difference in lateral thermal capacity of the thermal equalization member 42. Accordingly, the present embodiment prevents an incorrect assembly of the base 41 and the thermal equalization member 42 while the thermal equalization member 42 stably and effectively equalizes the temperature of the fixing belt 21. As described above, the rotation of the fixing belt 21 generates a great contact force between the base 41 and the thermal equalization member 42 on an upstream side of the nip formation member 24 in the sheet conveying direction. By contrast, on a downstream side of the nip formation member 24 in the sheet conveying direction, the rotation of the fixing belt 21 may create a gap between the base 41 and the thermal equalization member 42 in the sheet conveying direction. Therefore, in the present embodiment, the thermal equalization member 42 has the slit 42*c* on the downstream side of the nip formation member 24, thereby enhancing the mechanical strength of the nip formation member 24.

Figure 7:
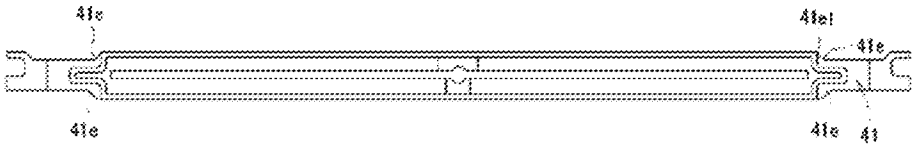
FIG. 7 is a rear view of a base.
Figure 8:
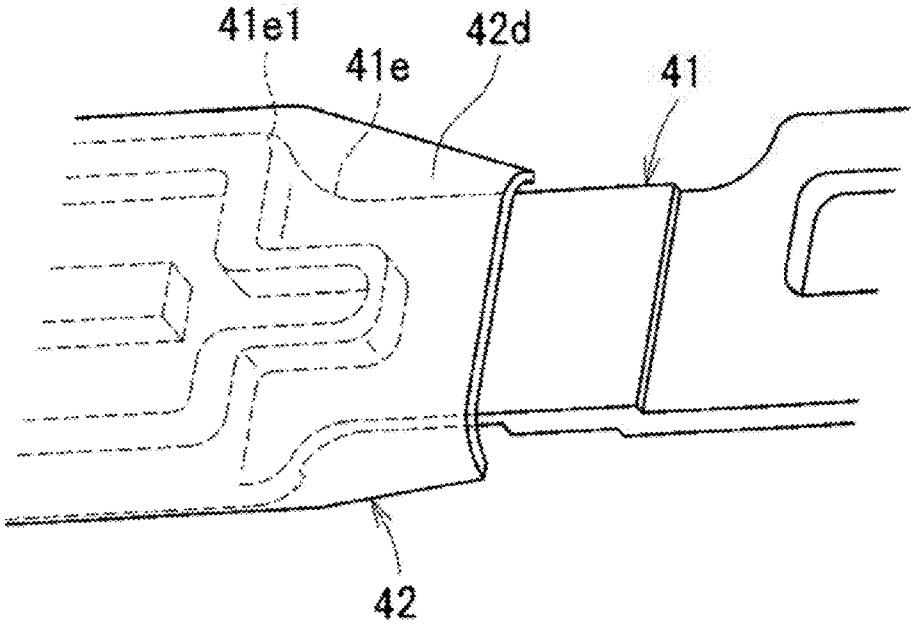
FIG. 8 is a perspective view of a rear, longitudinal end portion of the nip formation member.

Referring now to FIGS. 7 and 8, a description is given of converging portions of the base 41 and the thermal equalization member 42. FIG. 7 is a rear view of the base 41, illustrating a rear surface of the base 41 opposite the thermal equalization member 42. As illustrated in FIG. 7, the base 41 includes converging portions 41*e* in each of the opposed longitudinal end portions of the base 41. The converging portions 41*e* narrow the base 41 in the transverse direction of the base 41.

FIG. 8 is a perspective view of a rear, longitudinal end portion of the nip formation member 24. As illustrated in FIG. 8, the thermal equalization member 42 includes the converging portion 42*d* having a curved cross section in the longitudinal direction of the thermal equalization member 42. That is, the opposed longitudinal end portions of the thermal equalization member 42 are not square. When the fixing belt 21 slides over the opposed longitudinal end portions of the thermal equalization member 42, the converging portion 42*d* prevents the fixing belt 21 from being scraped or worn. On the other hand, the converging portions 41*e* of the base 41 narrow further longitudinal end portions of the base 41 in the transverse direction of the base 41. Accordingly, the base 41 is situated inside the converging portions 42*d* of the thermal equalization member 42.

FIGS. 7 and 8 illustrate a starting point 41*e*1 of the converging portion 41*e* of the base 41. The starting point 41*e*1 is a boundary between a curved surface portion and a flat surface portion of the base 41. In the present embodiment, an area including the starting point 41*e*1 of the base 41 contacts an inner surface of the corresponding converging portion 42*d* of the thermal equalization member 42, thereby restricting a longitudinal movement of the base 41 relative to the thermal equalization member 42.

Figure 9:
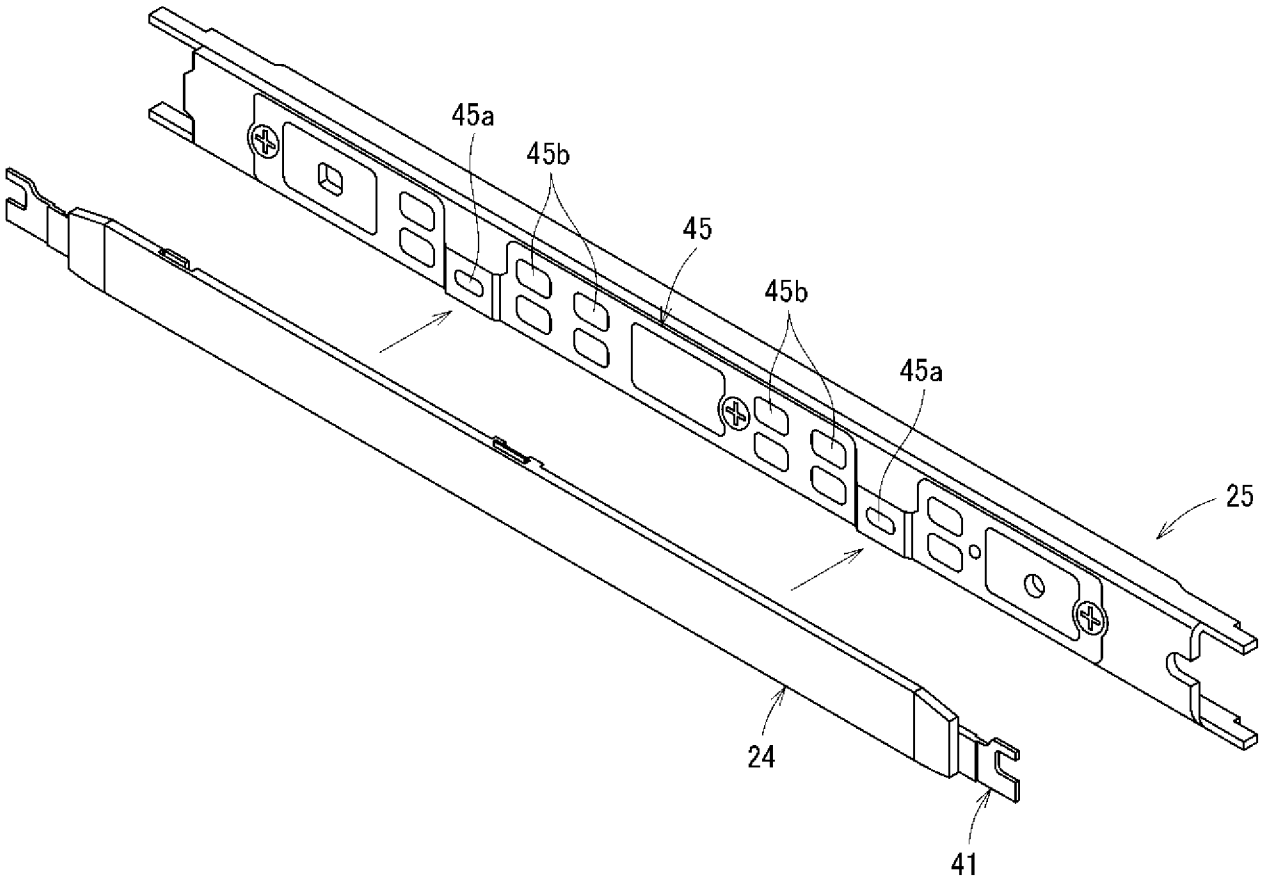
FIG. 9 is a perspective view of the nip formation member and a stay to be assembled.
Figure 10:
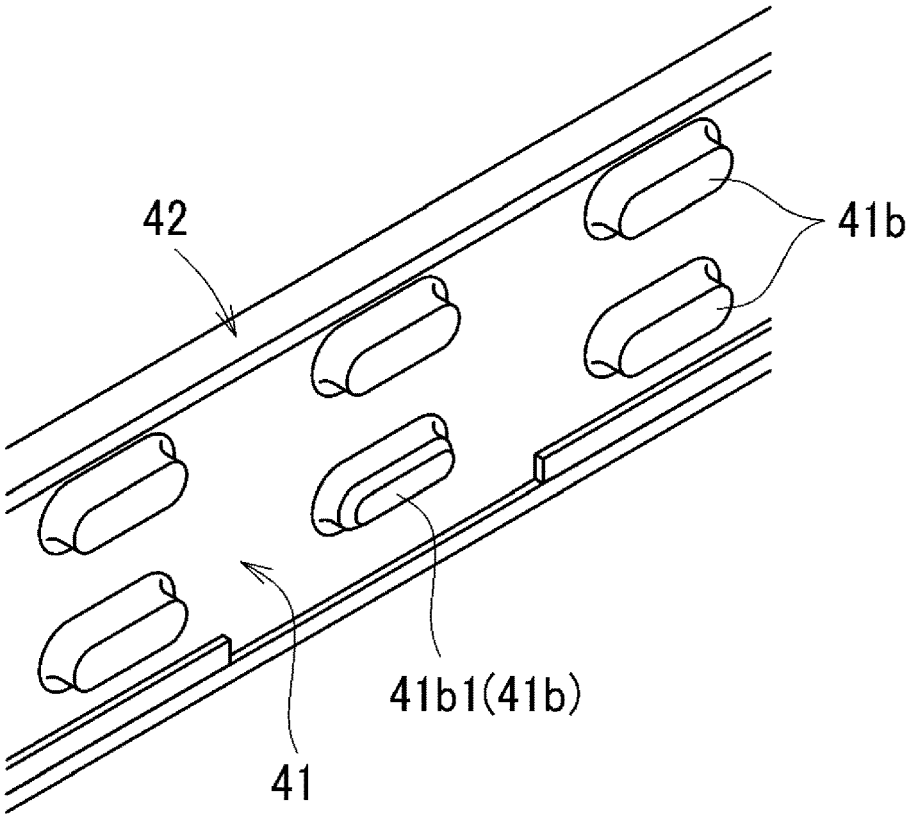
FIG. 10 is a partial perspective view of the base, illustrating a front surface of the base opposite the stay.

Referring now to FIGS. 9 and 10, a description is given of an assembly of the nip formation member 24 and the stay 25. FIG. 9 is a perspective view of the nip formation member 24 and the stay 25 to be assembled. FIG. 10 is a partial perspective view of the base 41, illustrating a front surface of the base 41 opposite the stay 25. Note that the nip formation member 24 is attached to the stay 25 in a direction indicated by arrows in FIG. 9.

As illustrated in FIG. 9, a holder 45 is secured onto a nip-side surface of the stay 25 opposite the nip formation member 24 to hold the nip formation member 24.

The holder 45 has holding holes 45*a* for holding the base 41 and other holes 45*b* located corresponding to the projections 41*b* of the base 41 illustrated in FIG. 6. A portion including each of the holding holes 45*a* of the holder 45 is shaped as a step, which projects toward the nip formation member 24 beyond the other portions of the holder 45.

As illustrated in FIGS. 6 and 10, the plurality of projections 41*b* of the base 41 includes projections 41*b*1 that are inserted into the holding holes 45*a* of the holder 45, respectively. Each of the projections 41*b*1 has a chamfered end surface opposite the holder 45 as illustrated in FIG. 10. The chamfered end surface allows a smooth insertion of the projection 41*b*1 into the holding hole 45*a*. Note that the other projections 41*b* serve as positioners that contact the stay 25 through the respective holes 45*b* of the holder 45, to position the nip formation member 24 relative to the stay 25.

Referring now to FIGS. 13A to 15 (FIGS. 13 to 15), a description is given of a structural comparison of the nip formation member 24 and a comparative nip formation member 124. Initially with reference to FIGS. 13A and 13B (FIG. 13), a description is given of different states of the nip formation member 24 related to the pressure exerted at the fixing nip N.

Figure 13A:
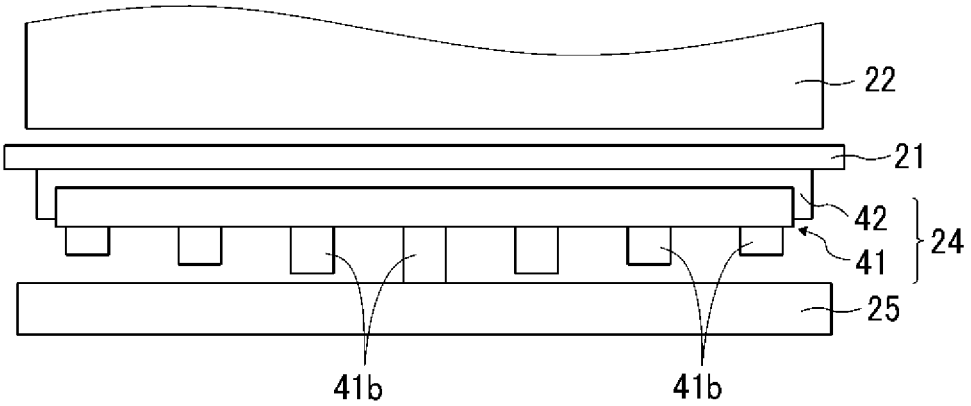
FIG. 13A and FIG. 13B (FIG. 13) are schematic views from an upstream side of the nip formation member and the peripheral components in a pressure relief state and a pressure state, respectively, in a direction of conveyance of a sheet.
Figure 13B:
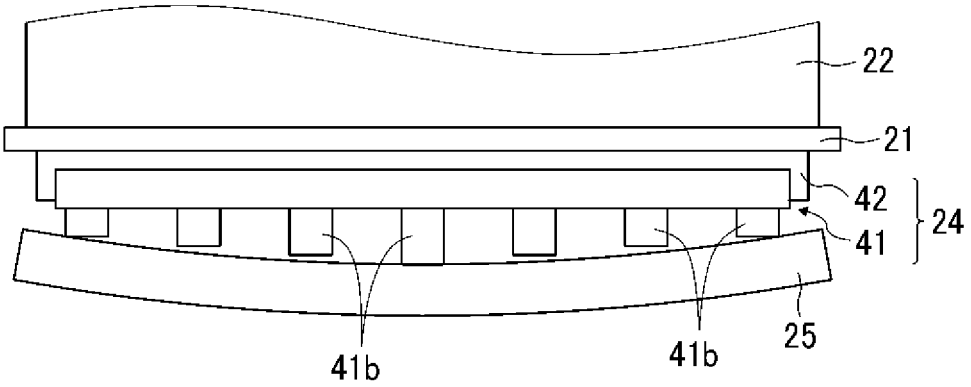

FIG. 13A is a schematic view from the upstream side of the nip formation member 24 and the peripheral components in a pressure relief state in the sheet conveying direction. FIG. 13B is a schematic view from the upstream side of the nip formation member 24 and the peripheral components in a pressure state in the sheet conveying direction. FIGS. 13A and 13B (FIG. 13) illustrate simplified configurations of the components for the sake of clarification.

As illustrated in FIG. 13A, the plurality of projections 41*b* of the base 41 has a height decreasing from the middle to the ends in the longitudinal direction of the base 41, resulting in formation of a gap between the stay 25 and the projections 41*b* on each of the opposed longitudinal end portions of the base 41.

As illustrated in FIG. 13B, in the pressure state in which the pressurization assembly presses the pressure roller 22 against the fixing belt 21, the pressure is transmitted to the stay 25 via the nip formation member 24, thereby bending the stay 25, particularly a longitudinal center portion of the stay 25, in a pressure direction in which the pressure is applied from the pressure roller 22 to the fixing belt 21. The stay 25 thus bent fills the gap between the stay 25 and the projections 41*b* on each of the opposed longitudinal end portions of the base 41. Accordingly, the plurality of projections 41*b* more uniformly contacts the stay 25 longitudinally along the base 41. In other words, since the stay 25 supports an overall length of the nip formation member 24, the nip formation member 24 forms a more uniform fixing nip N longitudinally along the nip formation member 24.

Figure 14:
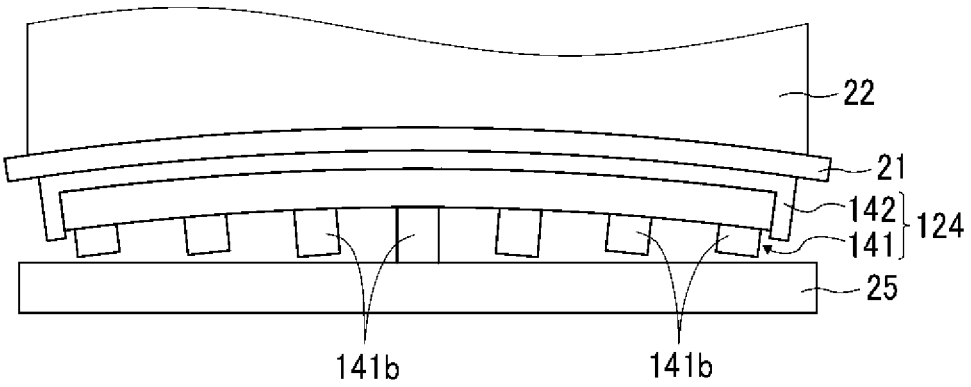
FIG. 14 is a schematic view of a comparative nip formation member that is bent.

By contrast, even in the pressure relief state in which the pressurization assembly does not press the pressure roller 22 against the fixing belt 21 as illustrated in FIG. 13A, the pressure roller 22 may expand toward the fixing belt 21 by the heat transmitted from the fixing belt 21 and press the nip formation member 24 via the fixing belt 21. FIG. 14 is a schematic view of the comparative nip formation member 124 that is bent. In the comparative nip formation member 124 illustrated in FIG. 14, a base 141 and a thermal equalization member 142 are secured to each other throughout the respective lengths of the base 141 and the thermal equalization member 142. When the pressure roller 22 presses the comparative nip formation member 124 via the fixing belt 21, the pressure from the pressure roller 22 is transmitted to the thermal equalization member 142 and further to the base 141 secured to the thermal equalization member 142, thereby bending the base 141 toward the stay 25. As the base 141 is bent, the thermal equalization member 142 secured to the base 141 is also bent toward the stay 25. Specifically, the base 141 made of resin is bent by the pressure more easily than the thermal equalization member 142 made of metal. Therefore, the bending of the thermal equalization member 142 follows the bending of the base 141. Opposed longitudinal end portions of the base 141 and the thermal equalization member 142 are particularly bent toward the stay 25 because of the gaps between the base 141 (specifically, projections 141*b*) and the stay 25. When the pressure roller 22 expands toward the fixing belt 21 by the heat transmitted from the fixing belt 21 and presses the comparative nip formation member 124 via the fixing belt 21, the pressure applied by the pressure roller 22 is smaller than the pressure applied by the pressure roller 22 that is pressed against the fixing belt 21 by the pressurization assembly. Such a smaller pressure hardly deforms the stay 25 elastically. As a consequence, the thermal equalization member 142 repeatedly bent may be damaged.

Figure 15:
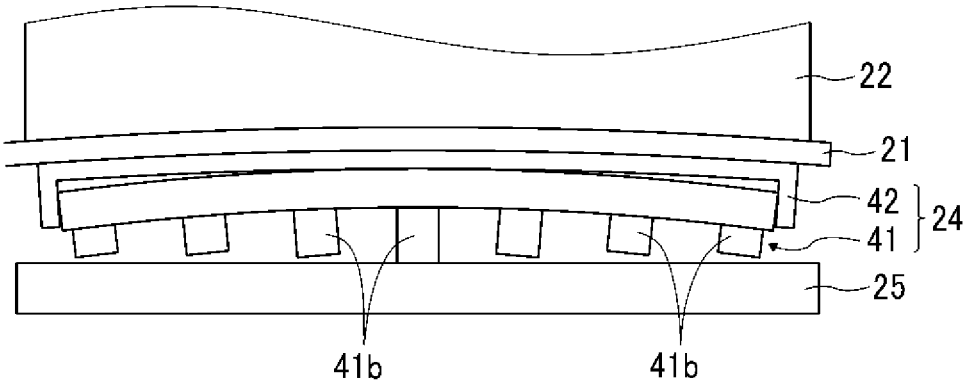
FIG. 15 is a schematic view of the nip formation member of FIG. 3 that is bent.

To address such a situation, in the present embodiment, simply the respective longitudinal center portions of the base 41 and the thermal equalization member 42 are secured to each other with the screw 43 and the securing member 44 disposed on the respective longitudinal center portions of the base 41 and the thermal equalization member 42 as illustrated in FIG. 5. FIG. 15 is a schematic view of the nip formation member 24 that is bent by the pressure that the nip formation member 24 receives from the pressure roller 22 that expands in the pressure relief state in which the pressure roller 22 is not pressed by the pressurization assembly. As illustrated in FIG. 15, the base 41 is bent while the thermal equalization member 42 is not bent in accordance with the bending of the base 41 because secured are simply the respective longitudinal center portions of the base 41 and the thermal equalization member 42. Thus, an amount of deformation of the thermal equalization member 42 is reduced. In particular, the deformation of the thermal equalization member 42 is effectively reduced on the opposed longitudinal end portions of the thermal equalization member 42. Such a configuration of the nip formation member 24 prevents damage to the thermal equalization member 42 due to repeated deformation. As described above, in the present embodiment, the respective longitudinal center portions of the base 41 and the thermal equalization member 42 are secured to each other. Preferably, respective longitudinal center points of the base 41 and the thermal equalization member 42 are secured to each other. In other words, the securing member 44 is attached to the longitudinal center portion, including the longitudinal center point, of the thermal equalization member 42 with the base 41 sandwiched between the securing member 44 and the thermal equalization member 42, thus securing the base 41 and the thermal equalization member 42 to each other.

The present embodiment has the advantage described above with the plurality of projections 41*b* having a height decreasing from the middle to the ends in the longitudinal direction of the base 41. Alternatively, for example, the plurality of projections 41*b* may have a substantially even height in the longitudinal direction of the base 41. In the present embodiment, the first insertion portion 44*b*1 and the second insertion portion 44*b*2 of the securing member 44 are inserted in the first insertion hole 42*b*1 and the second insertion hole 42*b*2 of the thermal equalization member 42, respectively. However, the embodiments of the present disclosure are not limited to the aforementioned configuration. One of the securing member 44 and thermal equalization member 42 includes an insertion portion while another one of the securing member 44 and the thermal equalization member 42 has an insertion hole in which the insertion portion is insertable.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

Figure 11:
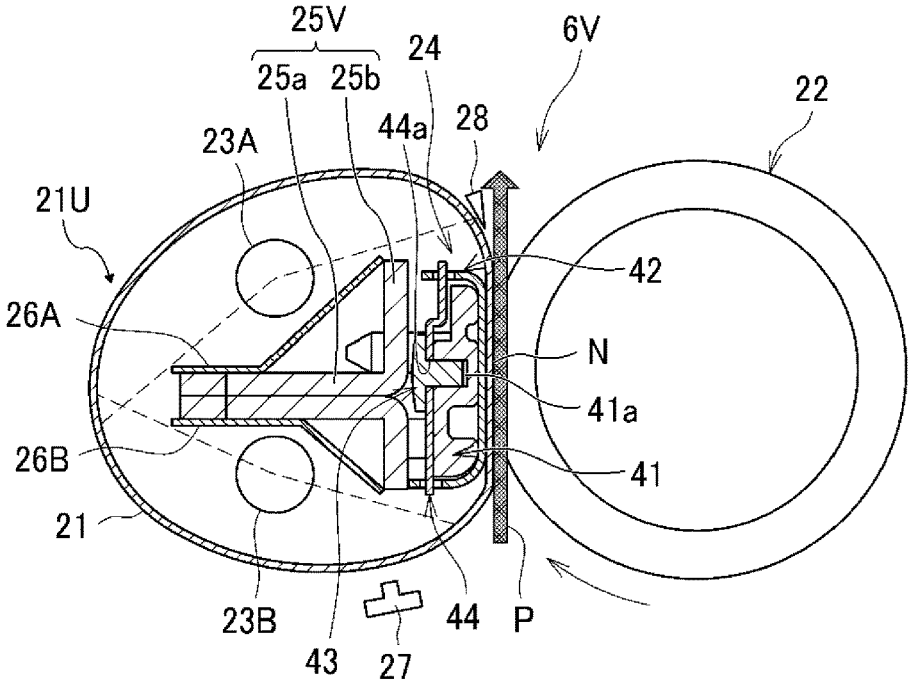
FIG. 11 is a cross-sectional view of a fixing device according to another embodiment of the present disclosure.
Figure 12:
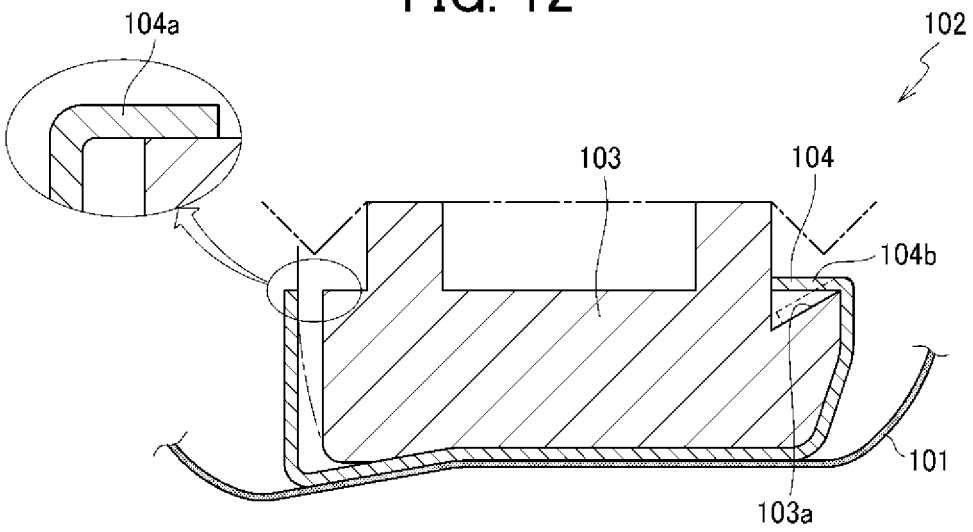
FIG. 12 is a cross-sectional view of a typical nip formation member.

The nip formation member 24 according to the embodiment described above is also applicable to a fixing device 6V provided with a plurality of heating members illustrated in FIG. 11. Referring now to FIG. 11, a description is given of the fixing device 6V according to another embodiment of the present disclosure, focusing on the differences between the fixing device 6 illustrated in FIG. 2 and the fixing device 6V illustrated in FIG. 11. Redundant descriptions of identical configurations are omitted unless otherwise required.

FIG. 11 is a cross-sectional view of the fixing device 6V. Similar to the fixing device 6 illustrated in FIG. 2, the fixing device 6V includes, e.g., the fixing belt 21 serving as a belt member (or a fixing member), the pressure roller 22 serving as an opposed member, and the nip formation member 24 as illustrated in FIG. 11. According to the present embodiment, the fixing device 6V includes two heaters 23A and 23B. One of the heaters 23A and 23B includes a center heat generator spanning a longitudinal center portion of the one of the heaters 23A and 23B to heat toner images on small sheets P passing through the fixing nip N. The other one of the heaters 23A and 23B includes a longitudinal end heat generator spanning each of opposed longitudinal end portions of the other one of the heaters 23A and 23B to heat toner images on large sheets P passing through the fixing nip N. In the present embodiment, the heaters 23A and 23B are halogen heaters. Alternatively, the heaters 23A and 23B may be, e.g., induction heaters, resistive heat generators, or carbon heaters.

The fixing device 6V includes a stay 25V having a T-shaped cross section as illustrated in FIG. 11. Specifically, the stay 25 includes an arm portion 25*a* projecting from a base portion 25*b* away from the fixing nip N. The arm portion 25*a* is interposed between the heaters 23A and 23B, thus separating the heaters 23A and 23B from each other.

The power source situated inside the image forming apparatus 1 supplies power to the heaters 23A and the 23B so that the heaters 23A and 23B generate heat. Specifically, the controller (e.g., a processor) is operatively connected to the power source and the temperature sensor 27 to control the power supply to the heaters 23A and 23B based on the temperature of the outer circumferential surface of the fixing belt 21 detected by the temperature sensor 27. Such heating control of the heaters 23A and 23B adjusts the temperature of the fixing belt 21 to a desired fixing temperature.

The fixing device 6V includes reflectors 26A and 26B interposed between the stay 25V and the heaters 23A and 23B, respectively, to reflect radiation heat from the heaters 23A and 23B toward the fixing belt 21, thereby enhancing heating efficiency of the heaters 23A and 23B to heat the fixing belt 21. In addition, the reflectors 26A and 26B prevent the stay 25 from being heated by the radiation heat from the heaters 23A and 23B, thus saving energy.

The nip formation member 24 having the aforementioned configuration is applicable to the fixing device 6V described above. That is, in the fixing device 6V, the base 41 and the thermal equalization member 42 are accurately positioned relative to each other. Accordingly, the fixing device 6V prevents unfavorable situations such as an image fixing failure and a paper jam.

The image forming apparatus according to the embodiments of the present disclosure is not limited to the color image forming apparatus 1 as illustrated in FIG. 1. Alternatively, the image forming apparatus may be a monochrome image forming apparatus that forms monochrome images on recording media. The image forming apparatus may be, e.g., a copier, a printer, a scanner, a facsimile machine, or a multifunction peripheral (MFP) having at least two of copying, printing, scanning, facsimile, and plotter functions.

Examples of the sheet P serving as a recording medium include plain paper, thick paper, a postcard, an envelope, thin paper, coated paper, art paper, tracing paper, an overhead projector (OHP) transparency, a plastic film, prepreg, and copper foil.

In the embodiments described above, the nip formation member 24 is applied to the fixing device 6 or the fixing device 6V disposed in the image forming apparatus 1. Alternatively, however, the nip formation member 24 is applicable to a drier that dries an object to be dried. For example, in an inkjet image forming apparatus, the nip formation member 24 is applicable to a drier that dries ink contained in an image formed on a recording medium such as a sheet of paper.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

This patent application is based on and claims priority pursuant to Japanese Patent Application Nos. 2019-038896, filed on Mar. 4, 2019, and 2019-116116, filed on Jun. 24, 2019, in the Japan Patent Office, the entire disclosure of each of which is hereby incorporated by reference herein.

REFERENCE SIGNS LIST

1 Image forming apparatus
6 Fixing device
21 Fixing belt (Fixing member)
22 Pressure roller (Opposed member)
23 Halogen heater (Heating member)
24 Nip formation member
25 Stay (Contact member)
41 Base
41*a* Fastening hole
41*b* Projection (Positioner)
41*c* Contact portion
41*d* Projection
41*e* Converging portion
41*f* Step portion (Step)
42 Thermal equalization member (High thermal conduction member)
42*a* Bent portion
42*b* Insertion hole
42*c* Slit (Relief portion)
42*d* Converging portion
43 Screw (Fastener)
44 Securing member
44*a* Fastening hole
44*b* Insertion portion
44*c* Step portion (Step)
45 Holder
N Fixing nip (Nip)
P Sheet (Recording medium)

The invention claimed is:

1. A nip formation member, comprising:
a base;
a thermal conductor having a thermal conductivity greater than a thermal conductivity of the base; and
a stabilizer independent from the base and the thermal conductor, the stabilizer to restrict movement of the base relative to the thermal conductor, the stabilizer having two ends and a middle, each of the two ends of the stabilizer attached the thermal conductor and the middle of the stabilizer contacting the base and securing the base towards the thermal conductor,
wherein a fastener secures the stabilizer to the base,
wherein the thermal conductor intersects the stabilizer.

2. The nip formation member according to claim 1,
wherein the stabilizer includes an insertion portion,
wherein the thermal conductor has an insertion hole, and
wherein the base is sandwiched between the stabilizer and the thermal conductor with the insertion portion in the insertion hole.

3. The nip formation member according to claim 1,
wherein the thermal conductor includes bent portions longitudinally along the thermal conductor on opposed transverse sides of the thermal conductor, respectively,
wherein the base is disposed in a recess defined by the bent portions on the opposed transverse sides of the thermal conductor, respectively,
wherein the stabilizer includes insertion portions,
wherein the bent portions have insertion holes, respectively, and
wherein the base is disposed opposite the thermal conductor via the base with the insertion portions in the insertion holes, respectively.

4. The nip formation member according to claim 1,
wherein one of the stabilizer and the thermal conductor includes insertion portions on opposed transverse sides of the thermal conductor, respectively,
wherein another one of the stabilizer and the thermal conductor has insertion holes on the opposed transverse sides of the thermal conductor, respectively, and
wherein the insertion portions are in the insertion holes, respectively.

5. The nip formation member according to claim 4,
wherein the base includes a guide extending in a transverse direction of the base to guide the stabilizer in a direction to attach the stabilizer to the base.

6. The nip formation member according to claim 5,
wherein the guide contacts a stay opposite the nip formation member, to position the nip formation member relative to the stay.

7. The nip formation member according to claim 1,
wherein the stabilizer and the base have steps shaped corresponding to each other.

8. The nip formation member according to claim 1,
wherein the stabilizer is attachable to a longitudinal center portion, including on a longitudinal center point, of the thermal conductor with the base sandwiched between the stabilizer and the thermal conductor.

9. The nip formation member according to claim 1,
wherein the stabilizer restricts the movement of the base relative to the thermal conductor in a thickness direction of the thermal conductor.

10. A fixing device comprising:
a fixing member;
an opposed member;
a heater to heat the fixing member; and
the nip formation member according to claim 1,
the nip formation member being disposed opposite an inner circumferential surface of the fixing member to form a fixing nip between the fixing member and the opposed member.

11. The fixing device according to claim 10,
wherein the fixing member includes one of a belt and a film.

12. An image forming apparatus comprising:
an image forming device to form a toner image; and
the fixing device according to claim 10,
the fixing device to fix the toner image onto a recording medium.

13. The nip formation member according to claim 1, wherein:
the thermal conductor is pulled towards the base by the stabilizer.

* * * * *